US010281237B2

(12) United States Patent
Liang

(10) Patent No.: US 10,281,237 B2
(45) Date of Patent: May 7, 2019

(54) SIGHT CAPABLE OF MEASURING DISTANCE

(71) Applicants: Sintai Optical (Shenzhen) Co., Ltd., Shenzhen, Guandong Province (CN); Asia Optical International Ltd., Tortola (GB)

(72) Inventor: Shang-Yung Liang, Taichung (TW)

(73) Assignees: SINTAI OPTICAL (SHENZHEN) CO., LTD, Shenzhen, Guangdong Province (CN); ASIA OPTICAL INTERNATIONAL LTD., Tortola, Virgin Islands (GB)

( * ) Notice: Subject to any disclaimer, the term of this patent is extended or adjusted under 35 U.S.C. 154(b) by 158 days.

(21) Appl. No.: 15/293,432

(22) Filed: Oct. 14, 2016

(65) Prior Publication Data

US 2017/0030681 A1 Feb. 2, 2017

Related U.S. Application Data

(63) Continuation-in-part of application No. 14/818,341, filed on Aug. 5, 2015.

(30) Foreign Application Priority Data

Aug. 12, 2014 (TW) ..... 103127652 A

(51) Int. Cl.
*F41G 1/35* (2006.01)
*F41G 3/06* (2006.01)
(Continued)

(52) U.S. Cl.
CPC ..... *F41G 3/065* (2013.01); *F41G 1/35* (2013.01); *F41G 1/387* (2013.01); *F41G 1/473* (2013.01); *F41G 11/003* (2013.01)

(58) Field of Classification Search
CPC ... F41G 3/06; F41G 3/065; F41G 3/08; F41G 1/35; F41G 1/38; F41G 1/387;
(Continued)

(56) References Cited

U.S. PATENT DOCUMENTS 2,774,142 A * 12/1956 Lake ..... F41G 11/001 42/126
6,252,706 B1 * 6/2001 Kaladgew ..... F41G 3/06 359/399

(Continued)

FOREIGN PATENT DOCUMENTS

CN 201378019 Y 1/2010

*Primary Examiner* — Stephone B Allen
*Assistant Examiner* — Adam W Booher
(74) *Attorney, Agent, or Firm* — McClure, Qualey & Rodack, LLP

(57) ABSTRACT

A sight capable of measuring distance comprises a telescope without any turrets, a laser transmitting module, a mount for adjusting elevation and windage and a power supply. The telescope comprises a barrel, an unadjustable reticle fixed in the barrel and a laser receiving module fixed in the barrel. The laser transmitting module is steadfastly fixed on the outer barrel of the telescope and emitting a laser beam toward the target. The mount for adjusting elevation and windage is fixed on a lower side of the outer barrel of telescope, and comprises a mounting part, an elevation adjusting part and a windage adjusting part. The power supply electrically connects to the laser transmitting module and the laser receiving module.

17 Claims, 9 Drawing Sheets

(51) Int. Cl.
*F41G 1/387* (2006.01)
*F41G 1/473* (2006.01)
*F41G 11/00* (2006.01)

(58) Field of Classification Search
CPC ..... F41G 1/473; F41G 11/00; F41G 11/001; F41G 11/003; F41G 11/005–11/008; G02B 7/00; G02B 7/02; G02B 7/021; G02B 23/00; G02B 23/14
See application file for complete search history.

(56) References Cited

U.S. PATENT DOCUMENTS

| | | | | |
|---|---|---|---|---|
| 8,240,075 | B1 | 8/2012 | Mullin | |
| 2005/0219690 | A1 | 10/2005 | Lin et al. | |
| 2005/0252062 | A1* | 11/2005 | Scrogin | F41G 1/38 42/119 |
| 2010/0175297 | A1* | 7/2010 | Speroni | F41G 1/35 42/114 |
| 2011/0247255 | A1 | 10/2011 | Ding et al. | |
| 2015/0323780 | A1* | 11/2015 | Hamilton | G02B 23/14 359/428 |

* cited by examiner

SIGHT CAPABLE OF MEASURING DISTANCE

CROSS REFERENCE TO RELATED APPLICATIONS

This application is a continuation-in-part application of U.S. patent application Ser. No. 14/818,341, "Sight capable of Measuring Distance", filed on Aug. 5, 2015, which claims priority to Taiwan Patent Application No. 103127652, filed Aug. 12, 2014, all of which are incorporated herein by reference in its entirety.

BACKGROUND OF THE INVENTION

Field of the Invention

The invention relates to a sight which is capable of measuring distance, and more particularly to a compact sight capable of measuring distance precisely without using any turrets.

Description of the Related Art

When using a gun to fire, people usually use a sight to aim a target. When aiming a target by using a conventional sight, people usually adjust elevation and windage to correct a bullet impact point according to a distance of the target and conditions of climate. People estimate the distance of the target based on people's experience of seeing through the conventional sight, but the distance estimation is not accurate and results in missing the target.

If people want to know the exact distance of the target, combining the sight with the rangefinder is a solution and U.S. Pat. No. 7,990,523 disclosed a sight combining with a rangefinder. However, when the turrets adjust the direction of the line of sight, the emitted measuring beam will not aim at the target unless the laser emitting module is adjusted automatically and simultaneously. Therefore, the solution of simply combing two individual sight and rangefinder together will result in big and heavy equipment. As a result, it is very inconvenient to use the conventional combination.

BRIEF SUMMARY OF THE INVENTION

To address the shortcomings discussed, the invention provides a sight capable of measuring distance, and this kind of sight has a smaller size, shorter length and lesser weight. The sight in accordance with an exemplary embodiment of the invention comprises a telescope, a laser transmitting module, a mount for adjusting elevation and windage and a power supply. The laser transmitting module is steadfastly fixed on the outer barrel of the telescope. The telescope comprises an unadjustable reticle securely fixed inside the barrel, and the telescope has no turrets to adjust the reticle. The mount for adjusting elevation and windage is fixed on a lower side of the outer barrel of the telescope. When the sight is mounted on a weapon, the mount for adjusting elevation and windage is disposed between the telescope and weapon. The mount for adjusting elevation and windage comprises a mounting part, an elevation adjusting part and a windage adjusting part.

In said embodiment, the telescope further comprises an objective lens set, an erecting lens set, and an eyepiece set, and the unadjustable reticle is fixed at a second focal plane of the telescope.

In said embodiment, the telescope further comprises a prism and a laser receiving element, the laser beam emitted by the laser transmitting module and reflected from the target enters into the telescope. The laser beam passing through the objective lens set is reflected by the prism and received by the laser receiving element.

In said embodiment, the laser transmitting module further comprises a laser source and a collimating lens set, and the laser source emits the laser beam which is collimated by the collimating lens set. When user uses the unadjustable reticle to aim a target and triggers the laser transmitting module, the laser beam hits the target.

In said embodiment, the mount for adjusting elevation and windage comprises a mounting part, a windage adjusting part and an elevation adjusting part, and the sight mounts on a weapon through the mounting part. The windage adjusting part adjusts the sight to move horizontally that corresponds to the horizontal trajectory, and the elevation adjusting part adjusts the sight to move vertically that corresponds to the vertical trajectory.

In said embodiment, the mounting part comprises a pair of parallel rods, a lateral plate, two mounting knobs, and two bayonets. The sight can be mounted on the weapon by forcing the lateral plate to clip the weapon. The two mounting knobs rotate around the bayonets so as to loose or tighten the lateral plate.

In said embodiment, the windage adjusting part comprises two forks fixed on the lower side of the outer barrel of telescope, a spiral screw rotatable along a first axis and held by the two forks, and a post extending from the mounting part having a screw hole engaging said spiral screw so that when rotating the spiral screw, the telescope moves relative to the mount for adjusting elevation and windage.

In said embodiment, the spiral screw comprises a first bolt having a first hollow cylinder and a second bolt having a protrusion which engages with the first hollow cylinder.

In said embodiment, the distance between two forks is a fixed value and determines the range of windage adjustment.

In said embodiment, the windage adjusting part comprises a limiting column which is held by the post and has the screw hole.

In said embodiment, the elevation adjusting part comprises a cylinder having screw thread on the outer surface of cylinder, and a nut disposed to be held by the telescope and screwed into the cylinder so as to move the telescope in a second axis by rotating the nut.

In said embodiment, the nut comprises a second hollow cylinder having screw thread in the inner wall of the second hollow cylinder.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is a preferable-contemplated mode of carrying out the invention. This description is made for the purpose of illustrating the general principles of the invention and should not be taken in a limiting sense. The scope of the invention is best determined by reference to the appended claims.

Figure 1:
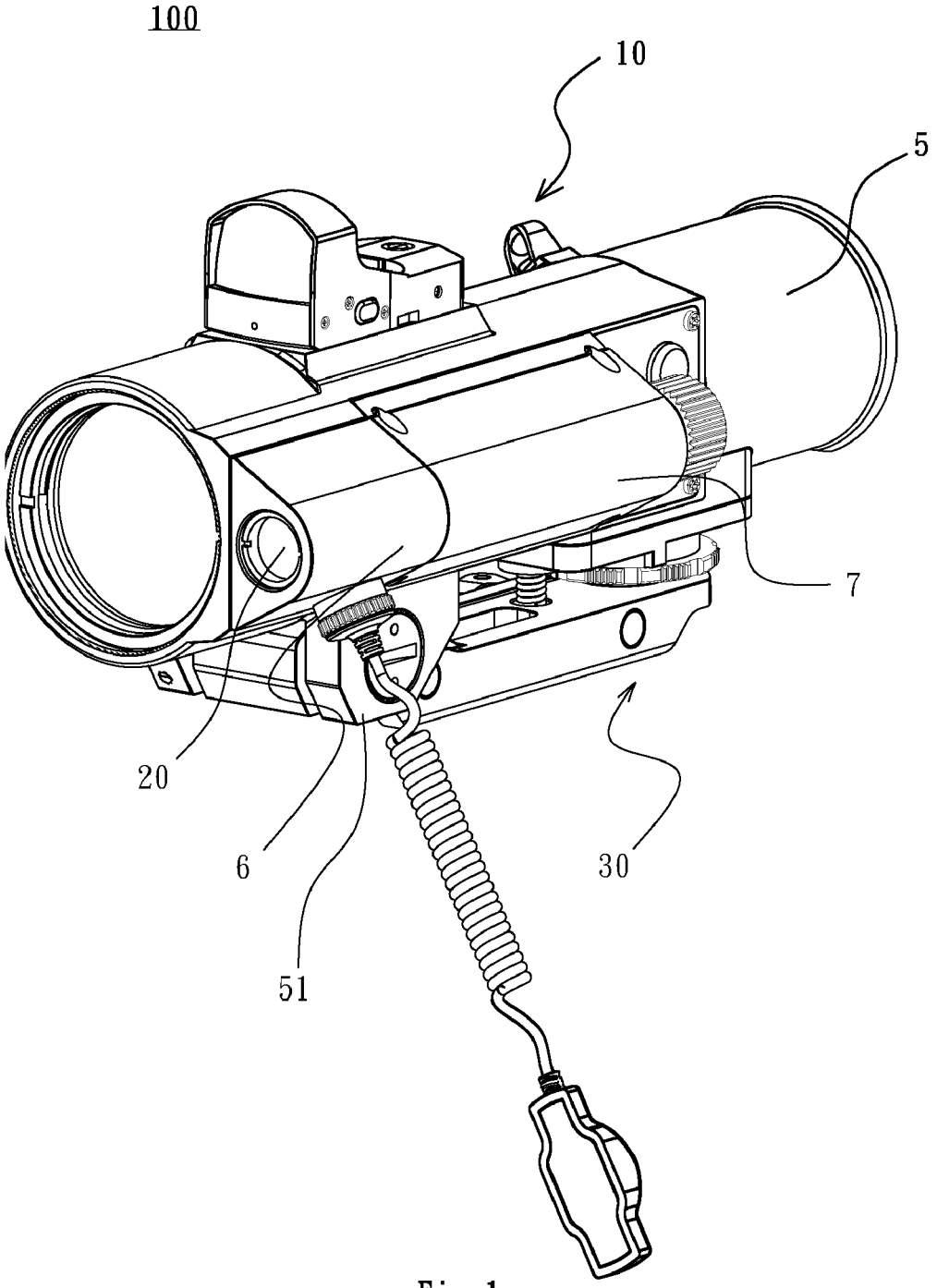
FIG. 1 is a three dimensional view of an embodiment showing a sight capable of measuring distance of the invention.
Figure 2:
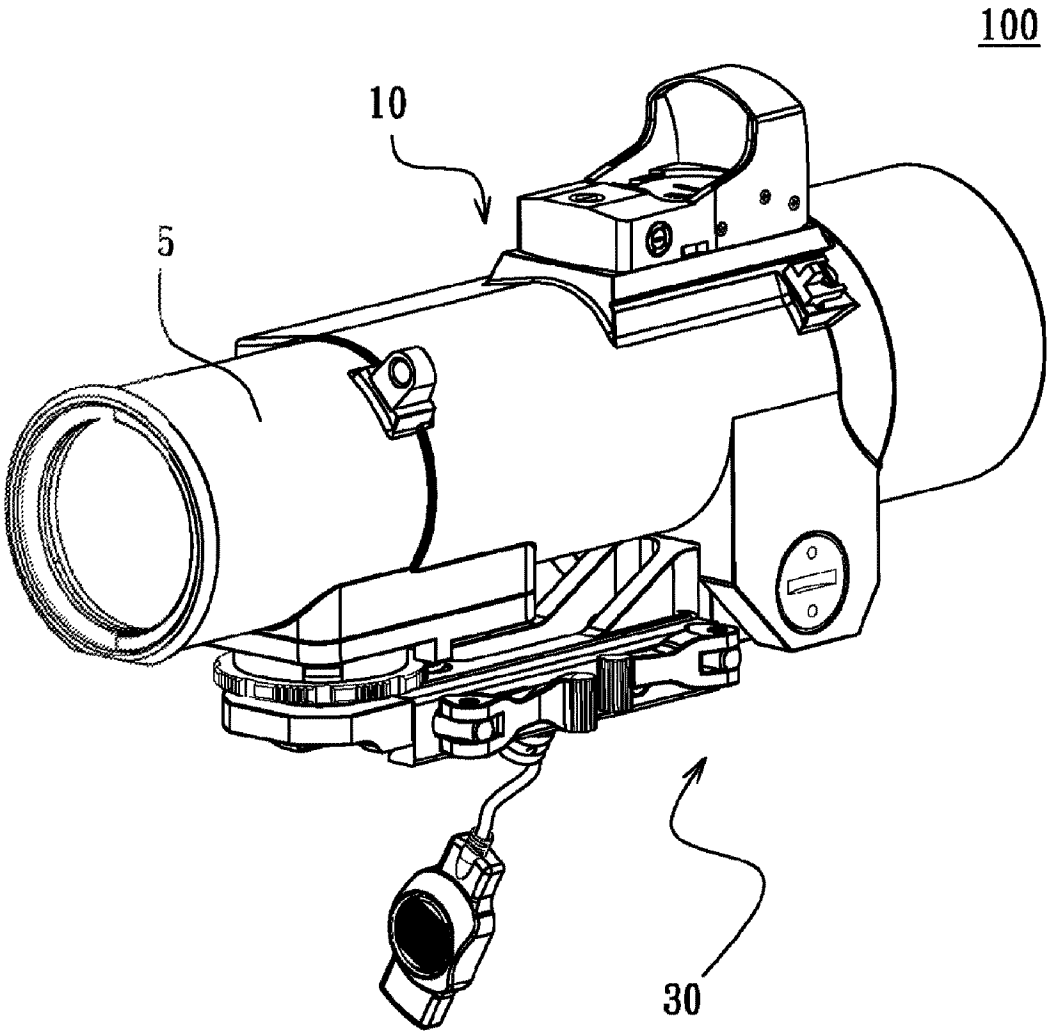
FIG. 2 is another three dimensional view of an embodiment showing a sight capable of measuring distance of the invention.

Referring to FIGS. 1 and 2, a sight 100 capable of measuring distance comprises a telescope 10, a laser transmitting module 20, and a mount for adjusting elevation and windage 30. The telescope 10 includes a barrel 5. The laser transmitting module 20 installed in a second housing 6, and the second housing 6 is steadfastly fixed on the outer barrel 5 of the telescope 10. A third housing 7 is steadfastly fixed on the outer barrel 5 of the telescope 10, and a power supply 40 (FIG. 4) is installed in the third housing 7. The power supply 40 connects electrically to the telescope 10 and the laser transmitting module 20 so as to supply power to the telescope 10 and the laser transmitting module 20. The power supply 40 can be a battery. The mount for adjusting elevation and windage 30 is fixed on a lower side of the outer barrel 5 of the telescope 10 so as to combine the sight 100 with a weapon, such as a rifle. Specifically speaking, the laser transmitting module 20 and the power supply 40 mounted on the same outer barrel 5 of the telescope 10 and the mount for adjusting elevation and windage 30 is disposed under the telescope 10.

Figure 3:
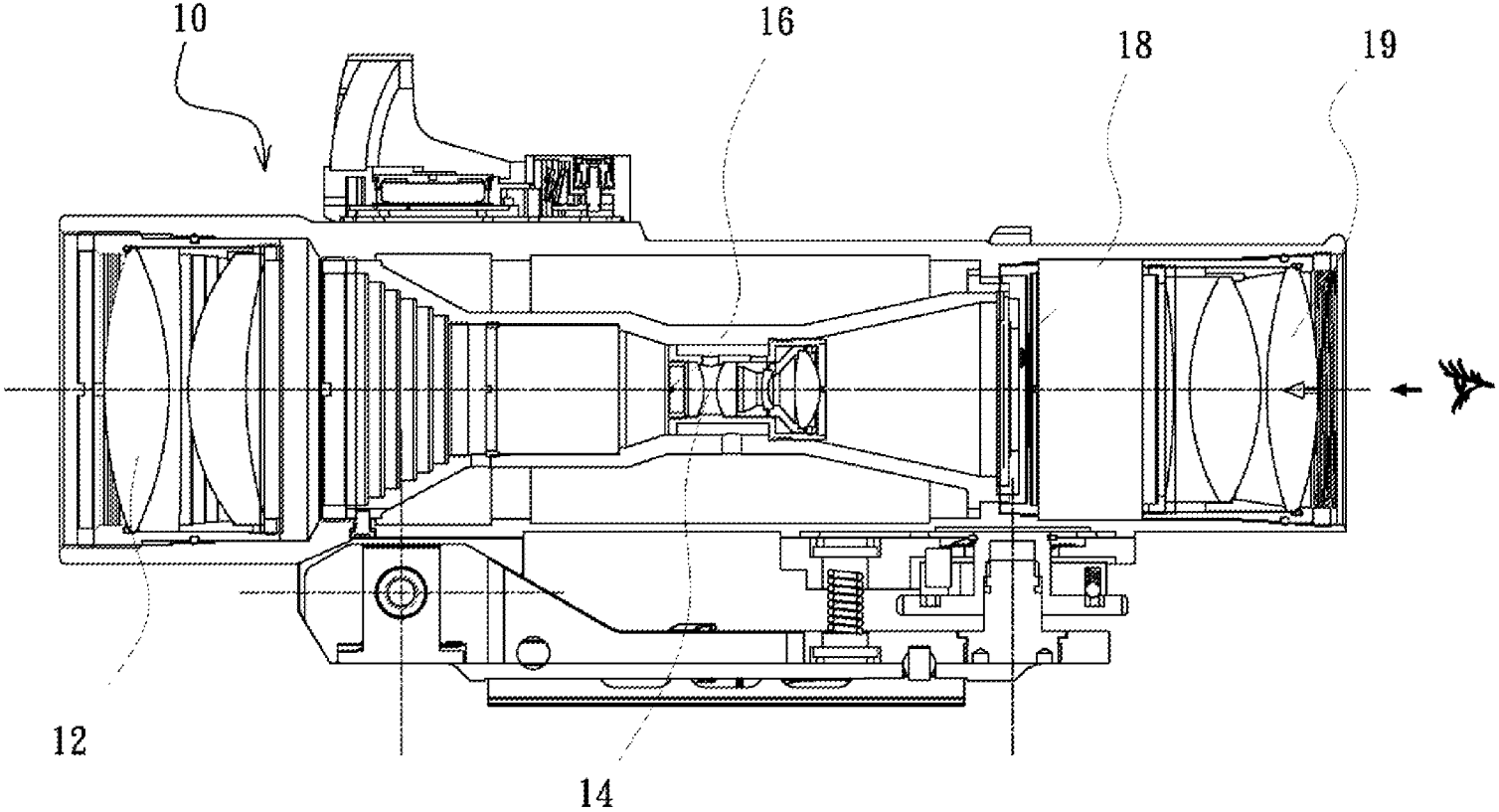
FIG. 3 is a perspective view of an embodiment showing a telescope of a sight capable of measuring distance.
Figure 4:
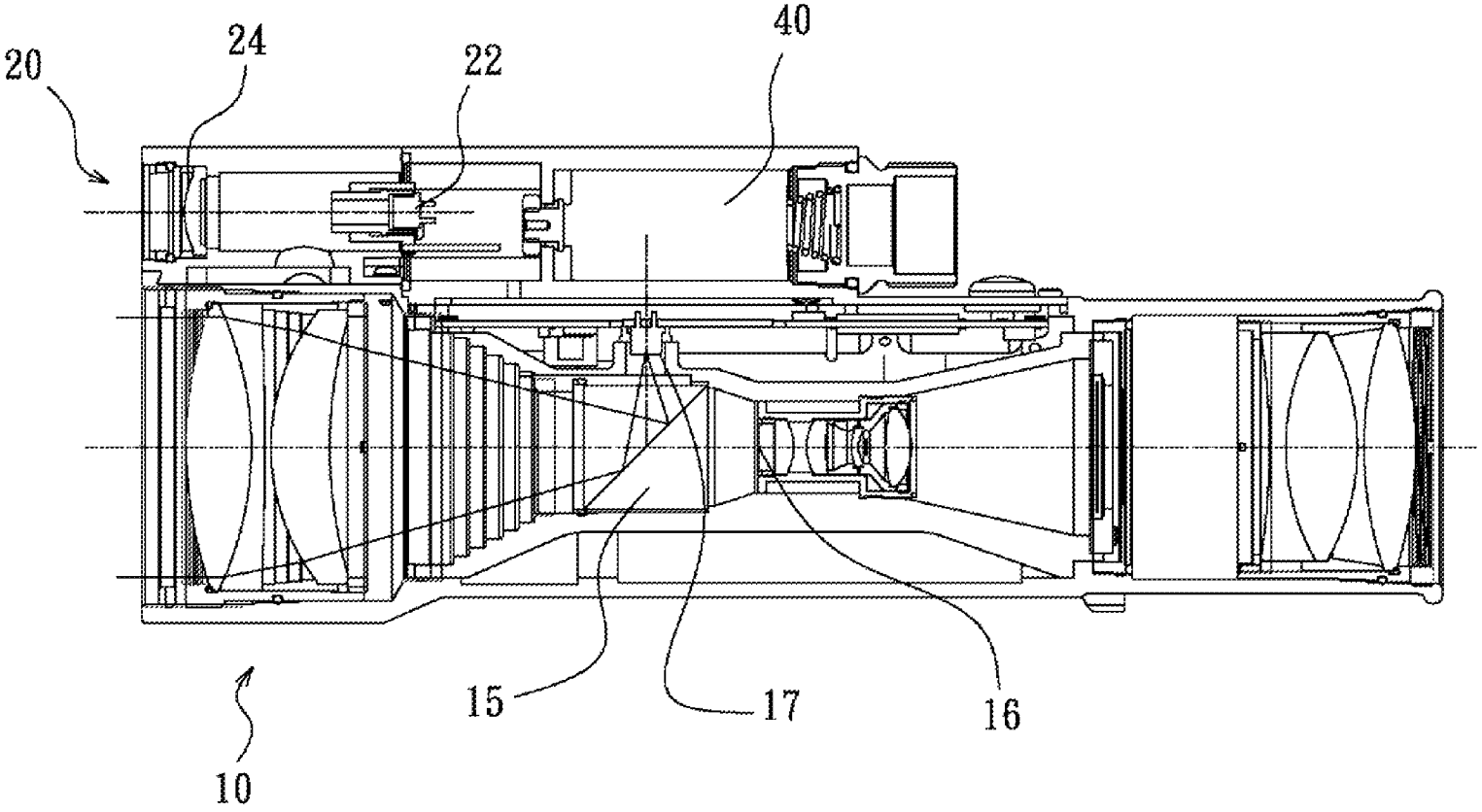
FIG. 4 is a perspective view of an embodiment showing a laser transmitting module of a sight capable of measuring distance.

The telescope 10 has the function of aiming the target and receiving laser beam reflected by the target simultaneously, and the two functions are integrated into one module. Then, the module installs in the barrel 5. Referring to FIGS. 3 and 4, the telescope 10 includes an objective lens set 12, an erecting lens set 14, a prism 15, a laser receiving element 17, an unadjustable reticle 18 and an eyepiece set 19. When aiming a target by the sight 100, the visible light of the target enters into the sight 100 and passes through the objective lens set 12, the prism 15 and the erecting lens set 14 in order, and then the visible light of the target images on the unadjustable reticle 18. (The reticle 18 is on the second focal plane)(The first focal plane is marked with number 16) A user can aim the target by the reticle 18 through the eyepiece set 19.

The laser transmitting module 20 includes a laser source 22 and a collimating lens set 24. If the use aims the target by the unadjustable reticle 18 and triggers the laser source 22 to emit the laser beam, the laser beam collimated by the collimating lens set 24 hits the target. Next, the laser beam reflected by the target passes through the objective lens set 12, and then it's reflected toward the laser receiving element 17 by the prism 15. Finally, the laser receiving element 17 receives the laser beam. As a result, the distance of the target can be obtained by calculating the signal of the laser beam and the numerical value of the distance of the target can be displayed on a display (not shown). The laser source 22 can be a laser diode (LD). The laser receiving element 17 can be an avalanche photo-detector (APD).

Figure 5A:
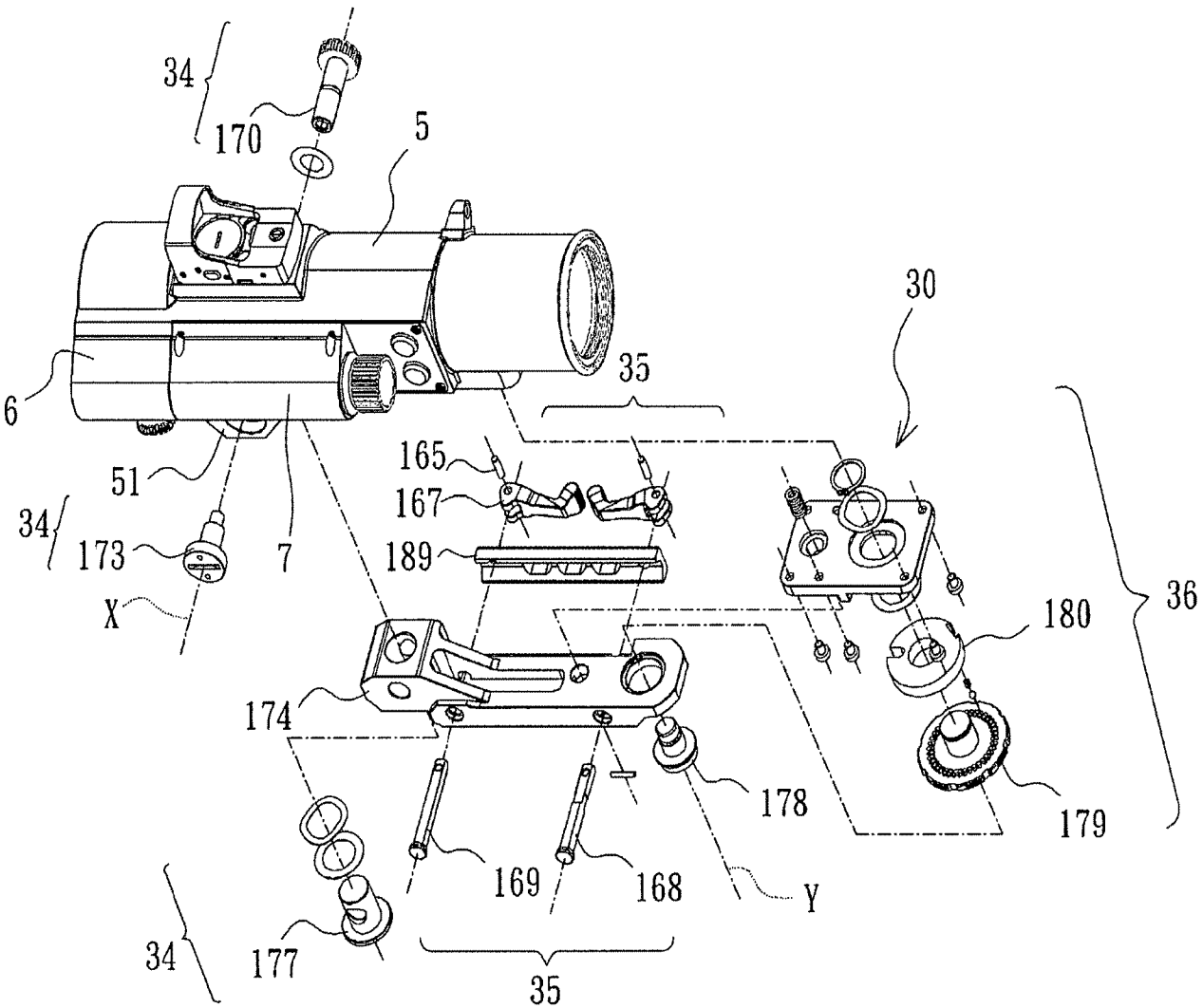
FIG. 5A is a top explosion view of the mount for adjusting elevation and windage.

FIG. 5A shows the mount for adjusting elevation and windage 30 of the sight 100. The mount for adjusting elevation and windage 30 comprises a windage adjusting part 34, a mounting part 35, and an elevation adjusting part 36. Below is the detail description of each part of the mount 30.

Figure 5B:
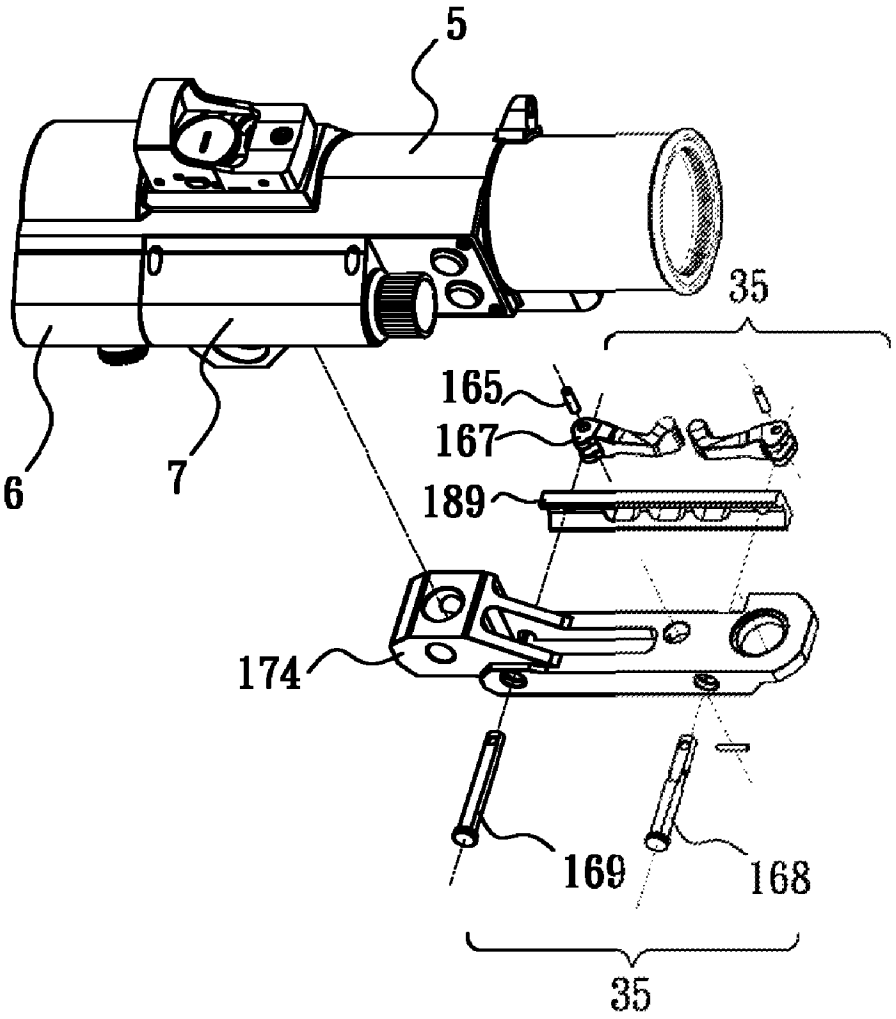
FIG. 5B is an explosion view of a mounting part of the mount for adjusting elevation and windage.

FIGS. 5A and 5B show the mounting part 35 comprising a post 174, a pair of parallel rods 168, 169, a lateral plate 189, two mounting knobs 167 and two bayonets 165. Each mounting knob 167 links one of the parallel rods respectively by one bayonet 165. When the user mounts the sight 100 on a weapon, such as a rifle, the mounting part 35 tightly holds the weapon by using the lateral plate. Each mounting knobs 167 is rotatable around its bayonet 165. In the embodiment, when rotating the two mounting knobs 167 to align them in one line which is parallel to the lateral plate 189, the two mounting knobs 167 tighten the lateral plate 189. Therefore, the sight 100 is mounted on the weapon tightly by the mounting part 35. When rotating the two mounting knobs 167 to be vertical to the lateral plate 189, the two mounting knobs 167 loose the lateral plate 189. Therefore, user can remove the sight 100 from the weapon easily.

Figure 5C:
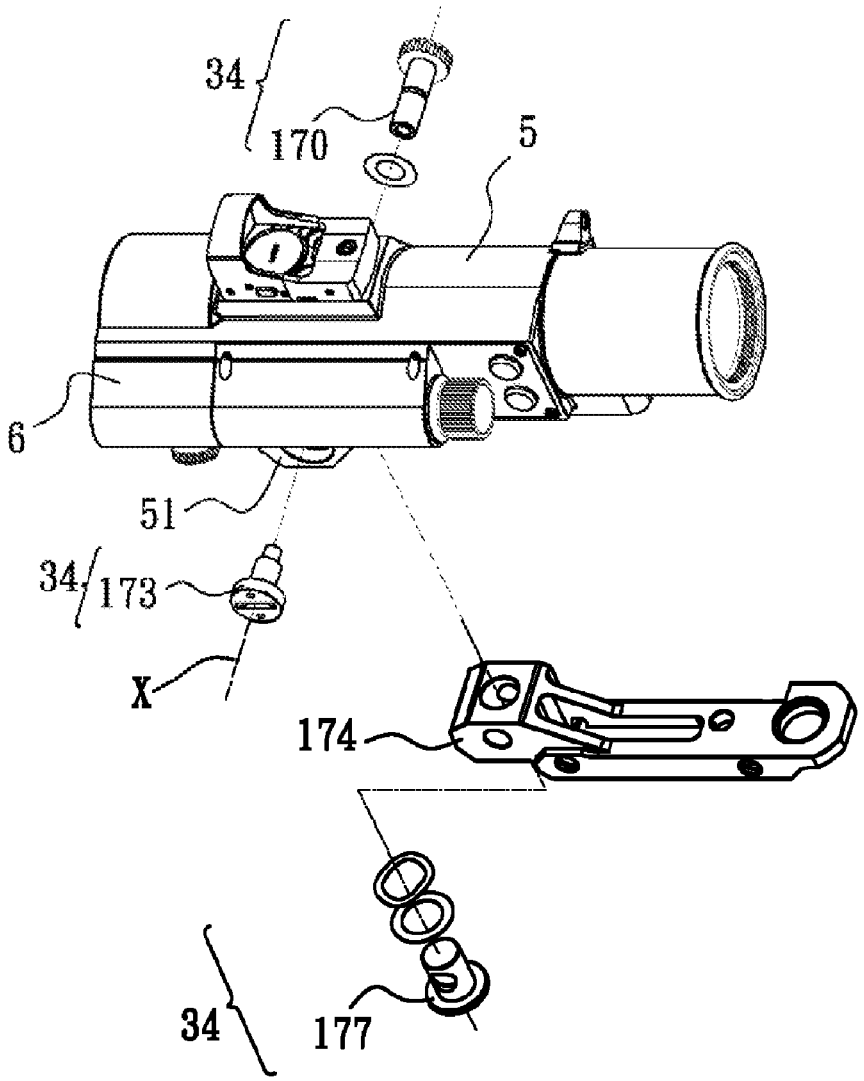
FIG. 5C is an explosion view of a windage adjusting part of the mount for adjusting elevation and windage.

FIGS. 5A and 5C show the windage adjusting part 34 comprising two forks 51, a post 174, a first bolt 170, a second bolt 173 and a limiting column 177. FIG. 5E depicts the two forks 51 are fixed on the lower side of the outer barrel 5 of the telescope 10 so that the interval between the two forks 51 is a fixed number. The first bolt 170 has a first hollow cylinder and the second bolt 173 has a protrusion which engages with the first hollow cylinder. Thus, the two bolts combine together as a spiral screw. Alternatively, the spiral screw is available by integrating the first bolt 170 with the second bolt 173. The post 174 is extending from the mounting part 35 and has a screw hole. The post 174 further has a penetrating hole and the limiting column 177 is mounted inside the penetrating hole. The limiting column 177 also has the screw hole and the screw hole of limiting column 177 is aligned with the screw hole of the post 174. The two forks 51 hold the spiral screw and the spiral screw is able to freely rotate without shift. The screw is further engaged by the screw holes. When rotating the spiral screw, the post 174 with the limiting column 177 is going to move along the spiral screw. Furthermore, the telescope 10 and the mount for adjusting elevation and windage 30 form a relative movement along the spiral screw, and the moving direction along the spiral screw defines a first axis, i.e. the X axis. When the sight 100 is mounted on a weapon by the mounting part 35, user is able to operate the windage adjustment by rotating the spiral screw. Therefore, the telescope 10 together with the laser transmitting module 20 moves relative to the mount 30 along the direction of first axis.

Figure 5D:
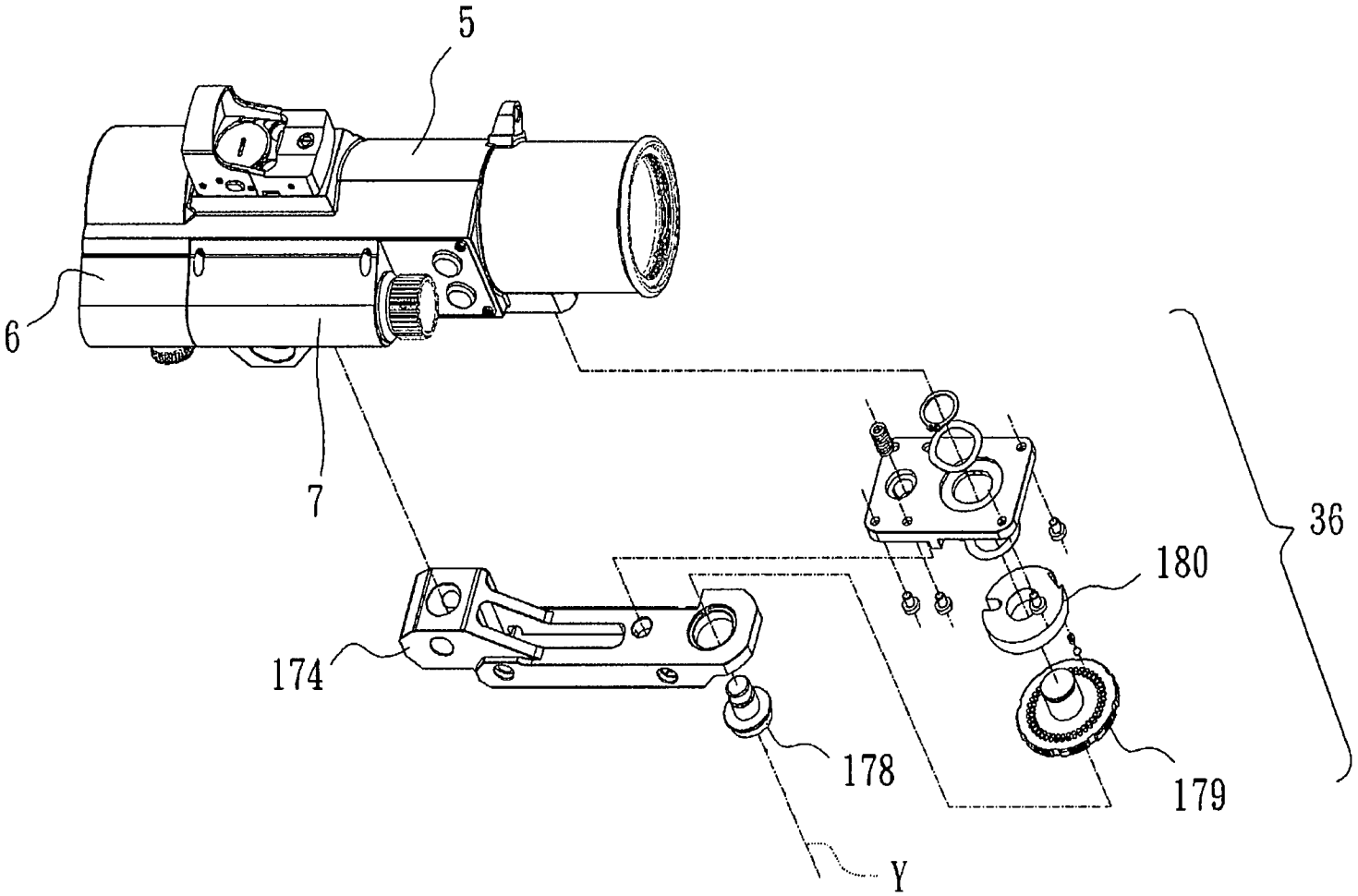
FIG. 5D is an explosion view of an elevation adjusting part of the mount for adjusting elevation and windage.
Figure 5E:
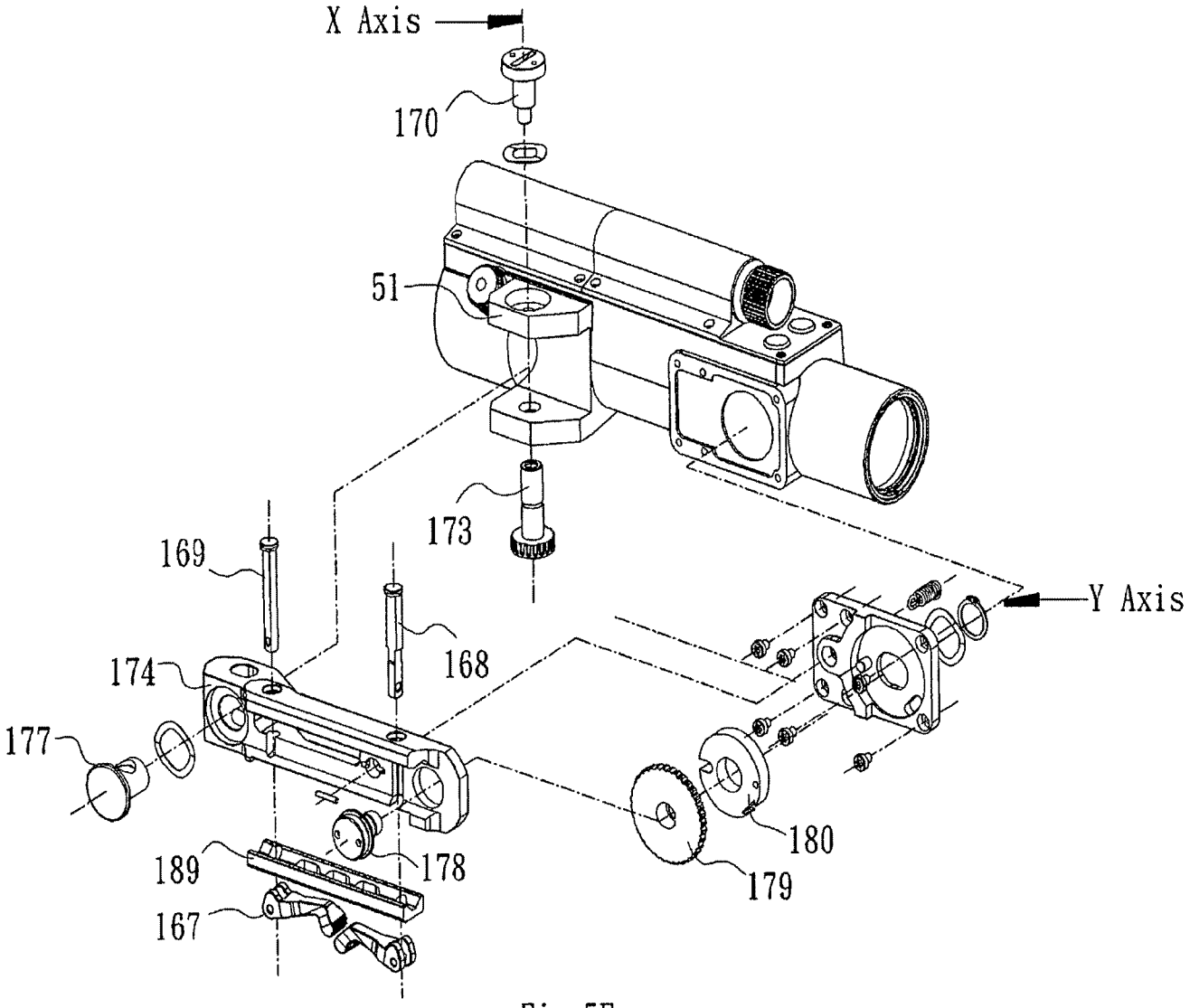
FIG. 5E is a bottom explosion view of the mount for adjusting elevation and windage.

FIGS. 5A and 5D show the elevation adjusting part 36 comprising a fixing bolt 178, a nut 179, and a spacing ring 180. The fixing bolt 178 is fastened to the mount 30 so as to form a cylinder having screw thread on the outer surface of cylinder. The nut 179 comprises a second hollow cylinder and inside the second hollow cylinder, screw thread is formed on the inner wall of the second hollow cylinder. The telescope 10 holds the nut 179, and the spacing ring 180 encircles the nut 179 and is located between the telescope 10 and the nut 179. The nut 179 is able to freely rotate without shift. The cylinder of the fixing bolt 178 screws into the second hollow cylinder of the nut 179. When rotating the nut 179, the telescope 10 with the nut 179 is going to move along the Y axis which is parallel to the cylinder of the fixing bolt 178. Furthermore, the telescope 10 and the mount for adjusting elevation and windage 30 form a relative movement along the Y axis. When the sight 100 is mounted on a weapon by the mounting part 35, user is able to operate the elevation adjustment by rotating the nut 179. Therefore, the telescope 10 together with the laser transmitting module 20 moves relative to the mount 30 along the direction of Y axis.

By said above description, the laser transmitting module 20 and the mount for adjusting elevation and windage 30 are not in the barrel 5. As a result, the length of this sight 100 is very short, and the invention can shorten the length of the sight 100 effectively. In this embodiment, the length of the sight 100 is no greater than 200 mm.

By mounting the sight 100 on a weapon, the sight 100 can measure the distance of the target so that a bullet impact point can be accurately correct when firing. As a result, the target can be hit exactly.

What is claimed is:

1. A sight capable of measuring distance of a target comprising:

a telescope without any turrets comprising a barrel, an unadjustable reticle fixed in the barrel and a laser receiving module fixed in the barrel;

a laser transmitting module steadfastly fixed on an outer part of the barrel of the telescope and emitting a laser beam toward the target;

a mount for adjusting elevation and windage which is fixed on a lower side of the outer part of the barrel of the telescope, and comprises a mounting part, an elevation adjusting part and a windage adjusting part; and a power supply electrically connecting to the laser transmitting module and the laser receiving module;

wherein the windage adjusting part comprises a fork fixed on the outer part of the barrel of the telescope, and a spiral screw rotatable along a first axis and held by the fork;

wherein the spiral screw comprises a first bolt having a first hollow cylinder and a second bolt having a protrusion which engages with the first hollow cylinder.

2. The sight capable of measuring distance of a target as claimed in claim 1, wherein the windage adjusting part further comprises a post extending from the mounting part having a screw hole engaging said spiral screw so that when rotating the spiral screw, the telescope moves relative to the mount for adjusting elevation and windage, and the fork is fixed on the lower side of the outer part of the barrel of the telescope.

3. The sight capable of measuring distance of a target as claimed in claim 2, wherein the elevation adjusting part comprises a cylinder having screw thread on an outer surface of the cylinder, and a nut disposed to be held by the telescope and screwed into the cylinder so as to move the telescope in a second axis by rotating the nut.

4. The sight capable of measuring distance of a target as claimed in claim 3, wherein the nut comprises a second hollow cylinder having screw thread in the inner wall of the second hollow cylinder.

5. The sight capable of measuring distance of a target as claimed in claim 1, wherein the windage adjusting part further comprises another fork, and a distance between the forks is a fixed value and determines a range of windage adjustment.

6. The sight capable of measuring distance of a target as claimed in claim 5, wherein the windage adjusting part further comprises a post extending from the mounting part having a screw hole engaging said spiral screw and a limiting column which is held by the post and has another screw hole.

7. The sight capable of measuring distance of a target as claimed in claim 6, wherein the elevation adjusting part comprises a cylinder having screw thread on an outer surface of the cylinder, and a nut disposed to be held by the telescope and screwed into the cylinder so as to move the telescope in a second axis by rotating the nut.

8. The sight capable of measuring distance of a target as claimed in claim 7, wherein the nut comprises a second hollow cylinder having screw thread in the inner wall of the second hollow cylinder.

9. The sight capable of measuring distance of a target as claimed in claim 5, wherein the elevation adjusting part comprises a cylinder having screw thread on an outer surface of the cylinder, and a nut disposed to be held by the telescope and screwed into the cylinder so as to move the telescope in a second axis by rotating the nut.

10. The sight capable of measuring distance of a target as claimed in claim 9, wherein the nut comprises a second hollow cylinder having screw thread in the inner wall of the second hollow cylinder.

11. The sight capable of measuring distance of a target as claimed in claim 1, wherein the laser transmitting module further comprises a laser source and a collimating lens set so that the laser source emits the laser beam which is collimated by the collimating lens set.

12. A sight capable of measuring distance of a target comprising:

a telescope without any turrets comprising a barrel, an unadjustable reticle fixed in the barrel and a laser receiving module fixed in the barrel;

a laser transmitting module steadfastly fixed on an outer part of the barrel of the telescope and emitting a laser beam toward the target;

a mount for adjusting elevation and windage which is fixed on a lower side of the outer part of the barrel of the telescope, and comprises a mounting part, an elevation adjusting part and a windage adjusting part; and a power supply electrically connecting to the laser transmitting module and the laser receiving module;

wherein the windage adjusting part comprises a fork fixed on the outer part of the barrel of the telescope, and a spiral screw rotatable along a first axis and held by the fork;

wherein the spiral screw comprises a first bolt having a first hollow cylinder and a second bolt having a protrusion which engages with the first hollow cylinder;

wherein the elevation adjusting part comprises a cylinder having screw thread on an outer surface of the cylinder, and a nut disposed to be held by the telescope and screwed into the cylinder so as to move the telescope in a second axis by rotating the nut.

13. The sight capable of measuring distance of a target as claimed in claim 12, wherein the nut comprises a second hollow cylinder having screw thread in the inner wall of the second hollow cylinder.

14. A sight capable of measuring distance of a target comprising:

a telescope without any turrets comprising a barrel, an unadjustable reticle fixed in the barrel and a laser receiving module fixed in the barrel;

a laser transmitting module steadfastly fixed on an outer part of the barrel of the telescope and emitting a laser beam toward the target;

a mount for adjusting elevation and windage which is fixed on a lower side of the outer part of the barrel of the telescope, and comprises a mounting part, an elevation adjusting part and a windage adjusting part; and a power supply electrically connecting to the laser transmitting module and the laser receiving module;

wherein the windage adjusting part comprises a fork fixed on the outer part of the barrel of the telescope, and a spiral screw rotatable along a first axis and held by the fork;

wherein the spiral screw comprises a first bolt having a first hollow cylinder and a second bolt having a protrusion which engages with the first hollow cylinder;

wherein the telescope further comprises an objective lens set, an erecting lens set and an eyepiece set, and the unadjustable reticle is fixed at a second focal plane of the telescope between the erecting lens set and the eyepiece set.

15. The sight capable of measuring distance of a target as claimed in claim 14, wherein the elevation adjusting part comprises a cylinder having screw thread on an outer surface of the cylinder, and a nut disposed to be held by the telescope and screwed into the cylinder so as to move the telescope in a second axis by rotating the nut.

16. The sight capable of measuring distance of a target as claimed in claim 15, wherein the nut comprises a second hollow cylinder having screw thread in the inner wall of the second hollow cylinder.

17. The sight capable of measuring distance of a target as claimed in claim 14, wherein the telescope further comprises a prism and a laser receiving element so that the laser beam emitted by the laser transmitting module and reflected from the target enters into the telescope.

* * * * *